US012486074B2

(12) United States Patent
Haon et al.

(10) Patent No.: US 12,486,074 B2
(45) Date of Patent: Dec. 2, 2025

(54) PACKAGING COMPRISING A PLASTIC CONTAINER WITH CONSTANT STACKING PITCH

(71) Applicant: ROQUETTE FRERES, Lestrem (FR)

(72) Inventors: Bruno Haon, La Couture (FR); Gauthier Lemaire, Fournes en Weppe (FR); Jérôme Mugnier, L'Abergement de Cuisery (FR); Stéphane Navoret, Saint Claude (FR)

(73) Assignee: Roquette Freres, Lestrem (FR)

( * ) Notice: Subject to any disclaimer, the term of this patent is extended or adjusted under 35 U.S.C. 154(b) by 728 days.

(21) Appl. No.: 17/059,052

(22) PCT Filed: May 27, 2019

(86) PCT No.: PCT/FR2019/051218

§ 371 (c)(1),
(2) Date: Aug. 9, 2021

(87) PCT Pub. No.: WO2019/229342

PCT Pub. Date: Dec. 5, 2019

(65) Prior Publication Data

US 2023/0219716 A1 Jul. 13, 2023

(30) Foreign Application Priority Data

May 28, 2018 (FR) ..... 1854484

(51) Int. Cl.
*B65D 21/02* (2006.01)
*B65D 43/02* (2006.01)
*B65D 71/00* (2006.01)

(52) U.S. Cl.
CPC ..... *B65D 21/0233* (2013.01); *B65D 21/0216* (2013.01); *B65D 21/0219* (2013.01);
(Continued)

(58) Field of Classification Search
CPC ..... B65D 21/0233; B65D 21/0216; B65D 21/0219; B65D 43/0249; B65D 71/0096;
(Continued)

(56) References Cited

U.S. PATENT DOCUMENTS 4,157,762 A * 6/1979 Robinson ..... B65D 43/0212 220/DIG. 13
4,412,630 A * 11/1983 Daenen ..... B65D 43/0218 220/792

(Continued)

FOREIGN PATENT DOCUMENTS

EP 1352842 A2 * 10/2003 ..... B65D 43/0256
EP 1380516 A1 1/2004

(Continued)

OTHER PUBLICATIONS

Winco PTC-23SG Slender Trash Can. Amazon. Retrieved from Internet: https://www.amazon.com/Winco-PTC-23SG-Slender-Trash-23-Gallon/dp/B003HEOUAM/ (Year: 2010).*

(Continued)

*Primary Examiner* — Nathan J Jenness
*Assistant Examiner* — Eric C Baldrighi

(57) ABSTRACT

The invention relates to a packaging comprising a plastic container (2), comprising side walls (20, 21, 22, 23) meeting in corners (24), an upper opening (25) and a bottom (26), as well as a detachable plastic lid configured to cover the upper opening of the container (2), and wherein said side walls (20, 21, 22, 23) of the container are divergent, together forming a truncated pyramid, configured so that said container can be stacked in an identical container. According to the invention, said container has projecting portions (29) extending from side walls at the upper opening (25) of the container, said projection portions (29) being external to the container, configured to guarantee a constant stacking pitch between
(Continued)

Figure 1A:
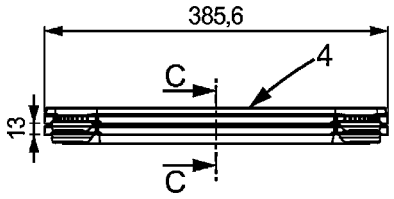

the container (2) and said identical container, when said container is stacked in said identical container.

14 Claims, 7 Drawing Sheets

(52) U.S. Cl.
CPC ..... *B65D 43/0249* (2013.01); *B65D 71/0096* (2013.01); *B65D 2543/00027* (2013.01); *B65D 2543/00101* (2013.01); *B65D 2543/00296* (2013.01); *B65D 2543/00518* (2013.01); *B65D 2543/00537* (2013.01); *B65D 2543/00555* (2013.01); *B65D 2543/00648* (2013.01); *B65D 2543/00685* (2013.01); *B65D 2543/00759* (2013.01); *B65D 2543/00796* (2013.01); *B65D 2543/00842* (2013.01)

(58) Field of Classification Search
CPC ..... B65D 2543/00027; B65D 2543/00101; B65D 2543/00296; B65D 2543/00518; B65D 2543/00537; B65D 2543/00555; B65D 2543/00648; B65D 2543/00685; B65D 2543/00759; B65D 2543/00796; B65D 2543/00842; B65D 2543/00509; B65D 2543/00629; B65D 2543/0074
USPC ..... 206/505
See application file for complete search history.

(56) References Cited

U.S. PATENT DOCUMENTS 4,804,092 A * 2/1989 Jones ..... B65D 43/0212 229/125.17
4,966,302 A * 10/1990 Hjordie ..... B65D 45/20 220/792
5,111,954 A 5/1992 Gaudreault
5,335,812 A * 8/1994 Boller ..... B65D 43/0256 220/267
5,823,345 A 10/1998 Nask et al.
5,979,690 A 11/1999 Hartley
8,925,755 B2 * 1/2015 Lesquir ..... B65D 43/0249 220/266
2004/0045966 A1 * 3/2004 Von Holdt, Jr. ... B65D 43/0256 220/276
2006/0011631 A1 * 1/2006 Dengel ..... B65D 43/0212 220/784
2006/0163265 A1 * 7/2006 De Candido ..... B29C 45/4407 220/784
2006/0226158 A1 10/2006 Britton
2013/0098914 A1 * 4/2013 Pudselykke ..... B65D 43/0212 220/270
2015/0375906 A1 * 12/2015 Vieker ..... B65D 43/0204 425/441
2017/0166352 A1 6/2017 Hoppe et al.
2019/0168927 A1 * 6/2019 Tyler ..... B65D 25/00

FOREIGN PATENT DOCUMENTS

FR 2514731 A1 * 10/1981 ..... B65D 21/0219
FR 2921909 A1 * 4/2009 ..... B65D 43/0256
FR 3005457 A1 11/2014
PT 103967 A * 4/2009 ..... B65D 43/02
WO 9609217 A1 3/1996
WO 9958412 A1 11/1999
WO WO-2014003697 A1 * 1/2014 ..... B65D 43/0258
WO WO-2019204697 A1 * 10/2019 ..... B65D 43/02

OTHER PUBLICATIONS

The English translation of the International Search Report and Written Opinion, mailed on Sep. 26, 2019, in the corresponding PCT Appl. No. PCT/FR2019/051218.
The English translation of the Chinese Office Action, mailed on Mar. 23, 2022, in the related Chinese Appl. No. 201980035706.2.
The Australian examination report No. 2, mailed on Aug. 14, 2024, in the related Australian Appl. No. 2019278696.

* cited by examiner

PACKAGING COMPRISING A PLASTIC CONTAINER WITH CONSTANT STACKING PITCH

The invention relates to a packaging comprising, on the one hand, a plastic container comprising side walls meeting in corners, an upper opening and a bottom and, on the other hand, a detachable plastic lid configured to cover the upper opening of the container.

The field of the invention is that of packaging powdered products in the food and/or pharmaceutical industry.

By way of non-limiting example, the powders in question may be the sorbitol NEOSORB®, the maltitol SWEETPEARL®, the xylitol XYLISORB®, the mannitol PEARLITOL®, etc., sold by the Applicant.

In this industry, it is common to package these powdered products with unit volumes of between 40 liters and 60 liters. These powders are currently packaged in a packaging which comprises a cardboard box body, typically a "kraft box" or less commonly a "kraft barrel". The "kraft box" essentially consists of a pre-cut and folded cardboard blank, with an automatic bottom, enabling the blank to be stored in a substantially flat position when not in use, and to be built by unfolding the automatic bottom. By way of comparison, the kraft barrel has the defect of being more expensive, in particular due to the use of metal strapping, and of being bulky when not in use; namely, it cannot be folded flat when not in use. In both cases, the powdered product is placed inside the box body, inside a hermetically sealed flexible bag.

A first problem with these paper packagings is that they generate fibers, which is a troublesome source of pollution for some sensitive industries wishing to isolate this type of fibrous pollution.

These packagings are furthermore transported by ship in containers over long distances and come into contact with insects. A second problem encountered is that of the box not being impervious to insects, which may even grow in the cardboard crimping of the box body during the delivery time, with insects penetrating into the internal volume. Occasionally, insects of Thysanoptera type are found trapped in the interspace between the flexible bag and the box body, inside said box.

In such a case, these packages are simply rejected by the industries (pharmaceutical or food) due to the contamination, causing a dead loss of the powdered products for the manufacturer, which constitutes a second problem for this type of paper packaging.

A third problem with such paper packagings is the fragility thereof, since they may possibly tear from impact or when they are subject to too much stress, for example when they are piled on top of one another. It is further important to highlight that the packaging of such powdered products must not degrade the specific characteristics of said powders, which may for example have, as a desired important characteristic, a particular texture that must not be degraded during delivery due to the movements of the transport and the friction caused to these powders.

The aim of the present invention is to overcome the abovementioned disadvantages by proposing a packaging which offers effective protection against insect contamination, the packaging not generating fibers, at an acceptable manufacturing cost, and which is not very bulky when the packaging is stored empty.

More particularly, the aim of the present invention is to propose such a packaging which does not damage the contents during the dynamic storage of products inside the packaging.

Another aim of the present invention is to propose such a packaging which can be opened easily, namely without tools.

Another aim of the present invention is to propose such an easy-open (tool-free) packaging that limits accidental opening during impacts.

Another aim of the present invention is to propose such a packaging having a tamper-proof seal to indicate fraudulent opening.

Another aim of the present invention is to propose, at least according to one embodiment, a packaging which can be piled up, in particular over several levels, such as three packages placed on top of one another, or even four packages placed on top of one another.

Another aim of the present invention is to propose such a packaging that makes it easy to check the contents without requiring the contents to be removed or even the lid to be removed from the packaging.

Other advantages of the invention will become apparent through the following description which is given only by way of non-limiting example.

Thus, the invention relates to a packaging comprising a plastic container, comprising side walls meeting in corners, an upper opening and a bottom, as well as a detachable plastic lid configured to cover the upper opening of the container, and wherein said container is provided, at the upper opening thereof, with a first engagement portion bearing an outwardly-directed ridge and extending over the periphery, said lid being provided, over the periphery thereof, with a second engagement portion extending downwardly in a folded manner and provided with an inwardly-directed ridge, which is able to attach below the ridge that is directed toward the outside of the container, and wherein said side walls of the container are divergent, together forming a truncated pyramid, configured so that said container can be stacked in an identical container.

According to the invention, said container has projecting portions extending from the side walls at the upper opening of the container and below said first engagement portion of the container, said projecting portions being outside the container and being configured to guarantee a constant stacking pitch between the container and said identical container, when said container is stacked in said identical container, said projecting portions being configured so as to cooperate in abutment with the upper edge of the upper opening of the identical container inside which said container is stacked so as to guarantee said stacking pitch.

According to the invention, moreover:

said projecting portions are in the form of outer ribs, extending vertically below said first engagement portion of the container, each vertical outer rib having, at the bottom end thereof, a flat part intended to cooperate in abutment with the upper edge of the upper opening of the identical container inside which said container is stacked, the second engagement portion of the lid has a skirt that extends over the lower part of the second engagement portion and wherein said outwardly-directed ridge of the container, on the one hand, and the inwardly-directed ridge of the lid, on the other hand, having curved corner sections in the corners where said side walls meet, where at least one of the curved corner sections of the inwardly-directed ridge is provided with a foldable skirt section, articulated via a folding region to the upper part of the engagement portion which is able to fold from an engagement position to an outwardly-directed released position such that a central part of said at least one curved corner section of the inwardly-directed ridge is spaced apart by levering from the outwardly-directed ridge of the upper opening and that the engagement between the ridges is thus weakened over said central part;

Also in a notable way, said projecting portions are arranged to project outwardly from the corners, at least one of the outer ribs extending, at the corners, from the bottom end thereof which forms the flat part and at least up to the height of said foldable skirt section when the inwardly-directed ridge is in the engagement position with the outwardly-directed ridge of the container.

Advantageously, the vertical ribs thus advantageously form obstacles that limit the risks of accidental opening of the foldable skirt sections, by deflecting unfortunate pushing by an object that might accidentally come to bear under the skirt section.

According to optional characteristics of the invention, taken alone or in combination:

the stacking pitch guarantees between the container and said identical container is such that the side walls of the container and the side walls of the identical container are spaced apart by a distance of between 0.4 mm and 1.2 mm;

the height of the outer rib in the vertical defines the stacking pitch, said outer rib extending from the flat part serving as a stop, at the bottom end thereof, up to the upper edge of the container, at the top end thereof;

said foldable skirt section is separated from the remaining skirt section by means of two grooves formed in the external surface of the skirt and extending downwardly from a folding region to the lower edge of the skirt, said grooves reducing the wall thickness of the skirt such that the skirt can be broken along the grooves in order to fold the foldable skirt section into the outwardly-directed position thereof;

said outer rib, in line with the foldable skirt section, is, along a horizontal direction passing through the plane of the outer rib, of increasing dimension between the lower end thereof that forms the flat part and the lower end of the foldable skirt section, said outer rib thus forming a ramp moving outwardly further away as the lower end of the foldable skirt section is approached from the flat part at the lower end of the vertical rib;

the first engagement portion of the container bearing said outwardly-directed ridge of the container extends downwardly in a folded manner, covering the side walls and the corners over the height of the container, with the presence of a peripheral cavity in the interspace between the outer surface of the side walls and the corners, on the one hand, and the folded section of the engagement portion, on the other hand, and wherein vertical reinforcing ribs are distributed in said cavity over the periphery of the container, each reinforcing rib connecting one of the side walls or wall of the corner, on the one hand, to said folded section of the first engagement portion, on the other hand;

the outer ribs guaranteeing the constant stacking pitch each extend from the bottom end thereof that forms the flat part, located below the cavity and said first engagement portion of the container and up to the inside of said cavity where said vertical outer rib is elongated forming one of the reinforcing ribs;

the first engagement portion of the container bearing the outwardly-directed ridge extends and is elongated below said ridge, referred to as first ridge, and ends below said first ridge in a second ridge, also outwardly-directed, and wherein the foldable skirt section bearing the inwardly-directed ridge able to attach to the first ridge bears, in the engagement position of the foldable skirt section, a second inwardly-directed ridge, able to attach to the second outwardly-directed ridge of the first engagement portion;

the inner surfaces of the container, including those of the bottom, the side walls and the corners, are smooth, devoid of ribs;

two handles extend, along the height of the container, each handle being positioned below the engagement portion of the container and above or at the level of the lower ends serving as stops of the projecting portions guaranteeing the constant stacking pitch, said handles extending in a laterally projecting manner from two opposite side walls of the container;

the side walls are four in number, the section (along a horizontal plane) of the container being rectangular;

the container has a usable capacity of between 40 liters and 60 liters.

According to one embodiment:

the dimension d1 being the overall dimension of the assembly along a first horizontal direction passing through the two handles and consisting of the distance separating the two handles, the dimension d2 being the overall dimension d2 along a horizontal direction perpendicular to the first horizontal direction and wherein $0.95\ d1<d2<1.05\ d1$;

According to one embodiment, the dimension in terms of thickness of the side walls is between 2 mm and 2.2 mm, the container is able to withstand a compressive force of between 40 kilograms and 105 kilograms, preferably of the order of 75 kilograms applied to the lid in the engagement position on the upper opening of the container.

According to one embodiment, the wall of the lid has a pre-cut opening closed by a breakable closure member, a breakable line, formed by a reduction in the section of the lid wall defining the contour of the closure member and said pre-cut opening, said breakable line being configured such that manual pressure on the breakable closure member ensures the breakage of the breakable line and thus the release of the pre-cut opening.

Optionally, said breakable line extends at the periphery of the closure member with the exception of a region intended to form a retaining tab for the closure member once it has been severed, said breakable line being configured such that manual pressure on the breakable closure member ensures the breakage of the breakable line and thus the release of the pre-cut opening, then the holding of the closure member below the wall of the lid via said flexible retaining tab.

According to one embodiment, the lid is substantially of rectangular shape, comprising four corners and wherein the pre-cut opening and the breakable closure member are located on the lid, at a distance from the corners, along an axis of symmetry of the lid, and in an off-center position relative to the center of the lid.

The invention will be particularly used for packaging food or pharmaceutical powders, directly contained in the inner volume of the container of the packaging, or indirectly contained in a flexible leaktight bag internal to said container of said packaging.

The invention further relates to a method for manufacturing a packaging according to the invention, wherein the container and said lid are obtained by injection molding.

Figure 2A:
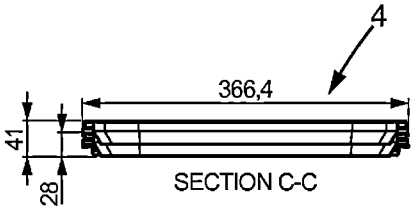
Figure 1B:
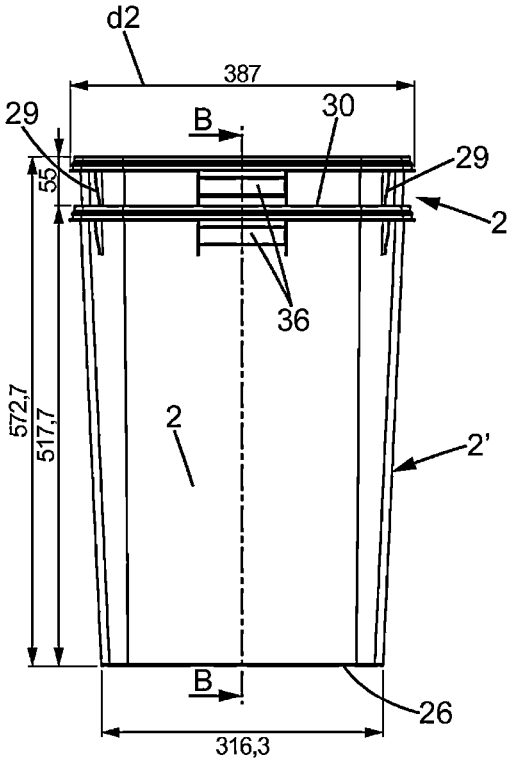
Figure 2B:
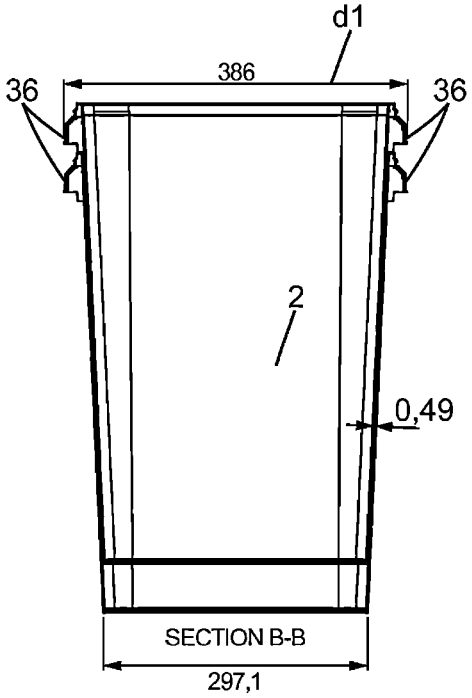

The invention will be better understood upon reading the following description accompanied by the drawings, in which:

FIGS. 1*a* and 1*b* are respectively views of a plurality of lids, and of a plurality of containers, belonging to packagings in accordance with the invention, when not in use, FIG. 1*a* illustrating the stacking of the lids inside one another, FIG. 1*b* illustrating the stacking of the containers inside one another, FIGS. 2*a* and 2*b* are respectively views along the section C-C in FIG. 1*a* and along the section B-B in FIG. 1*b*.

Figure 3A:
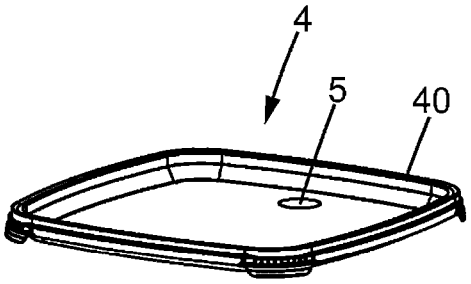
Figure 3B:
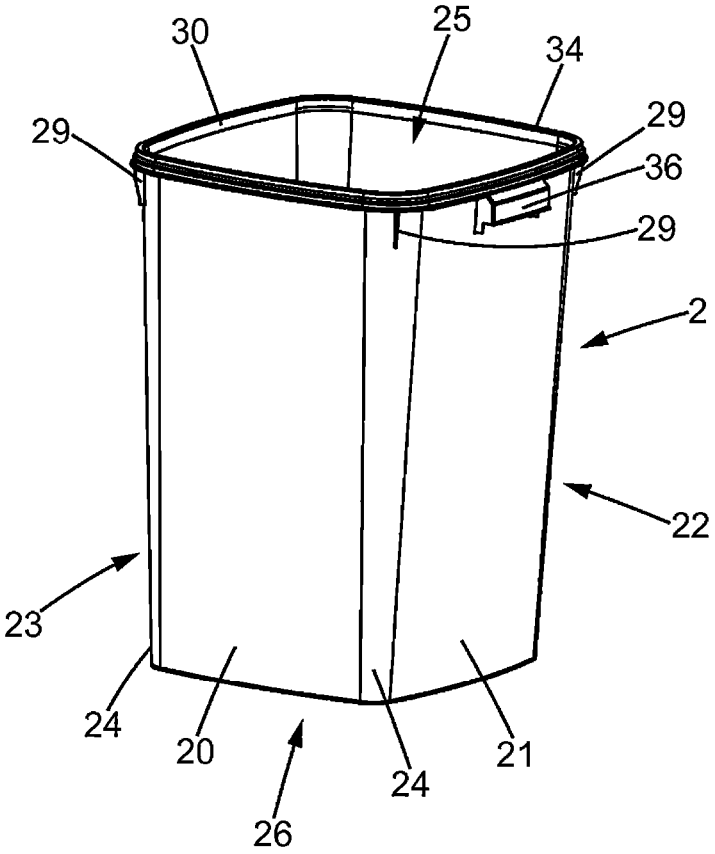
Figure 4:
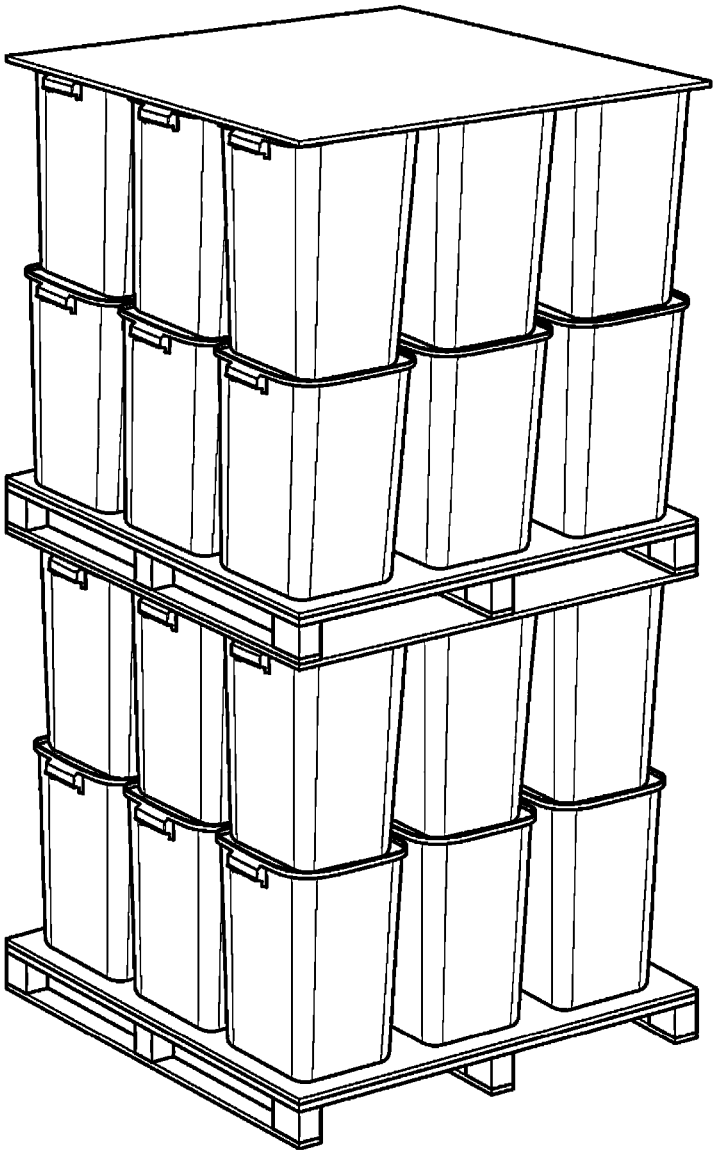
Figure 5:
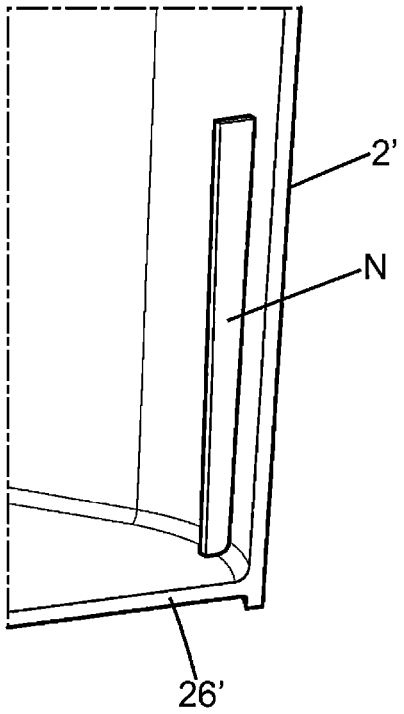
Figure 6:
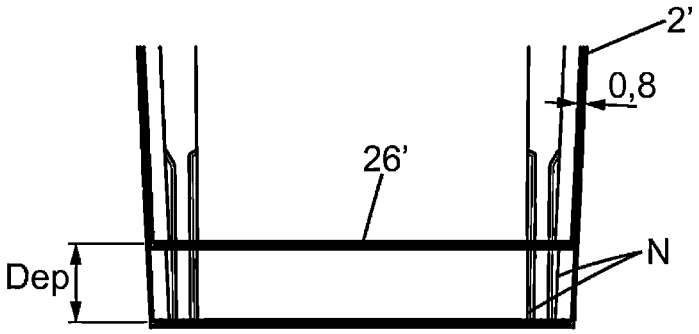
Figure 7:
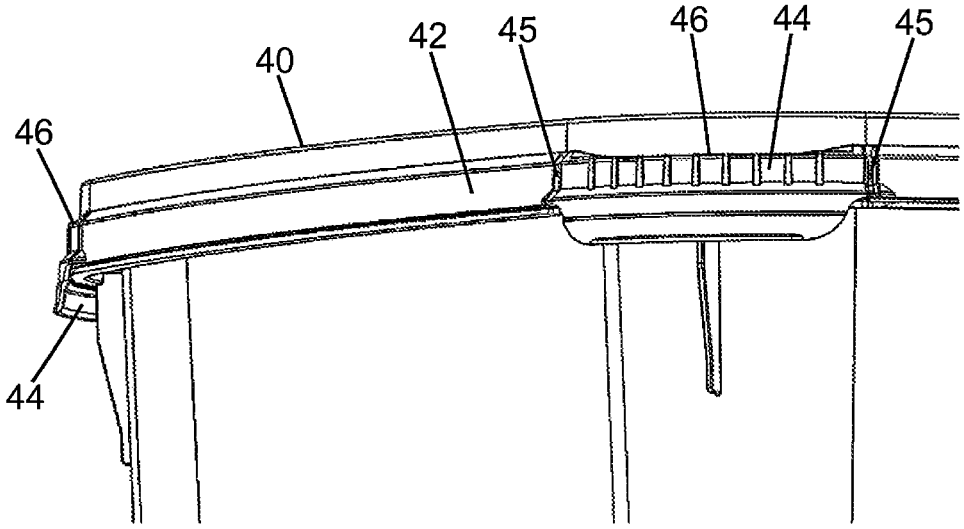
Figure 8:
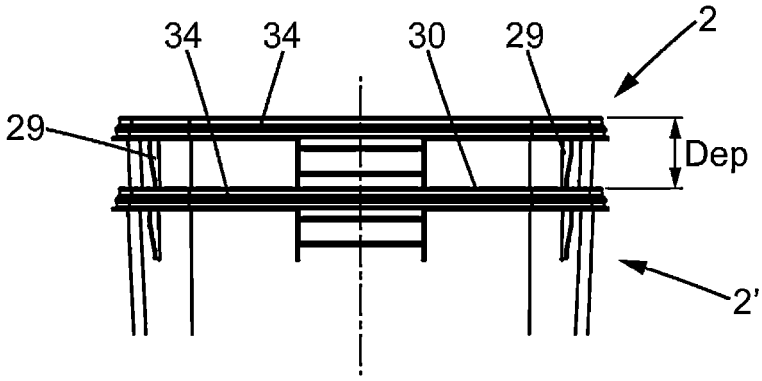
Figure 9:
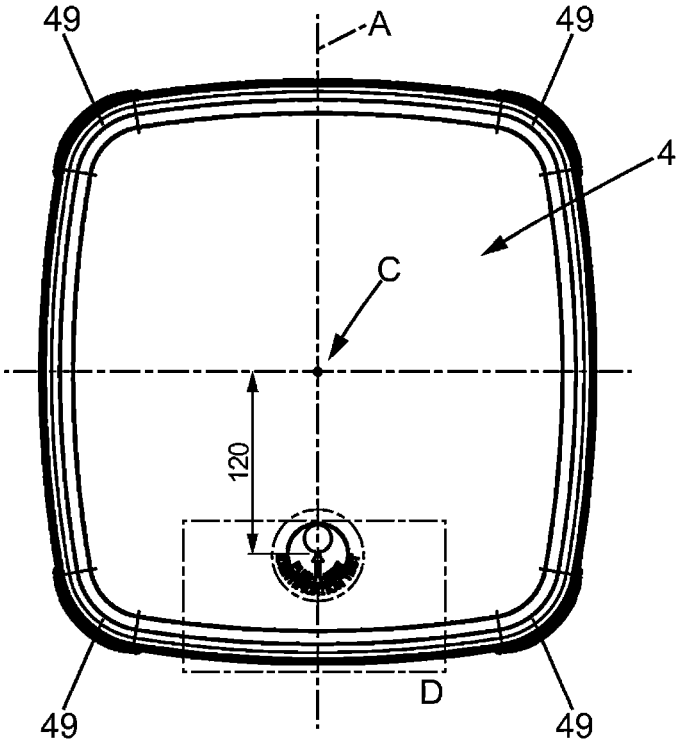
Figure 10:
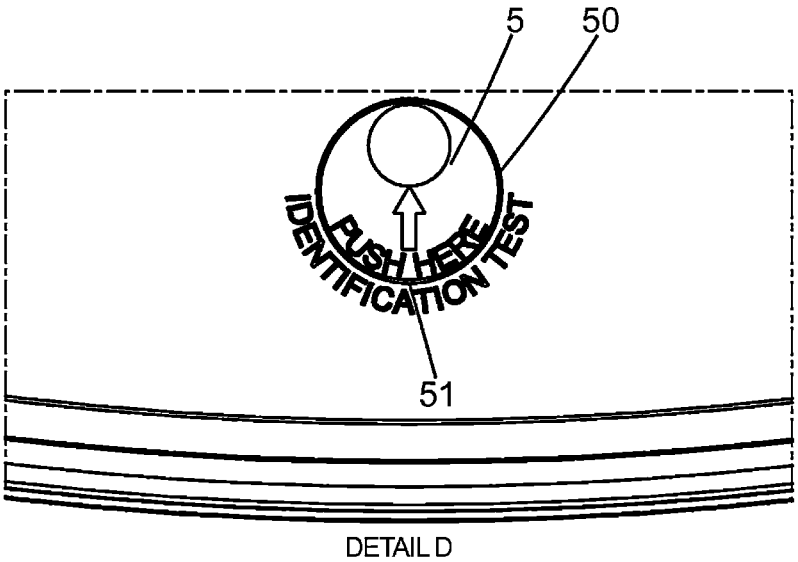
Figure 11:
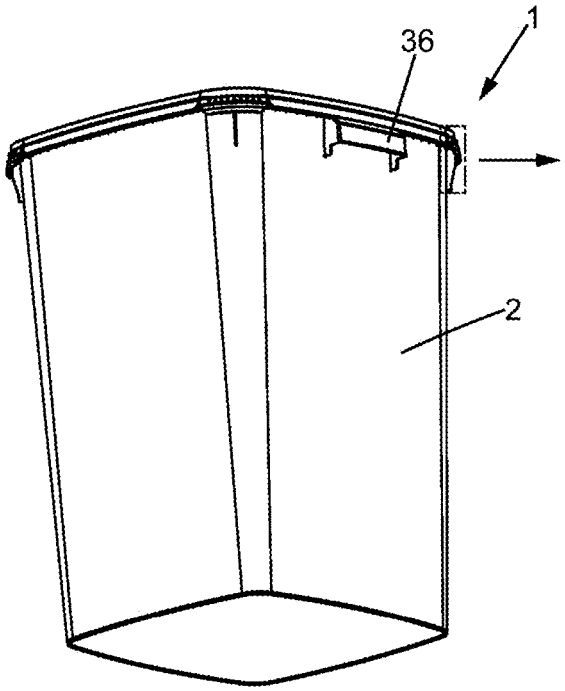
Figure 12:
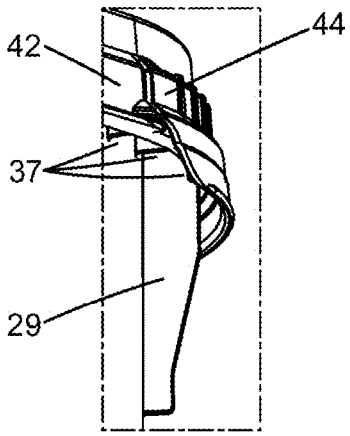
Figure 13:
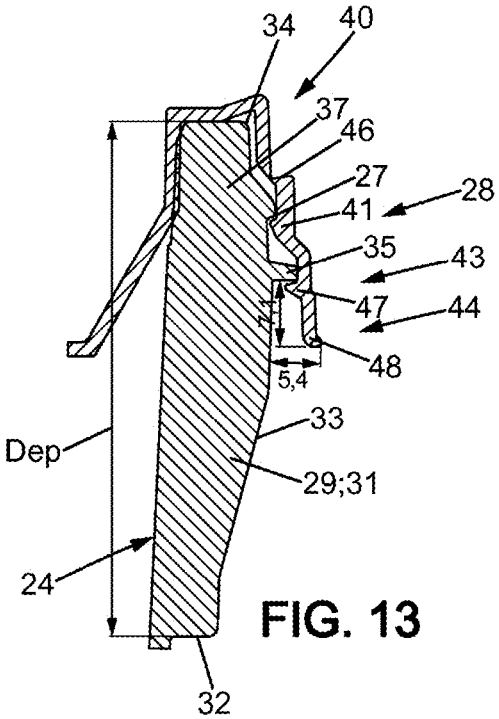
Figure 14:
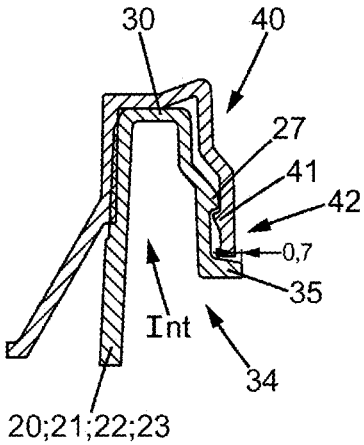

FIG. 3*a* and FIG. 3*b* respectively are perspective views of a lid and of a container of a packaging in accordance with the invention, FIG. 4 is a perspective view of a packaging set-up comprising a 1140 mm×1140 mm pallet on which four packaging beds rest, piled one on top of the other, each bed being formed of 9 packagings arranged side-by-side according to a square configuration (3×3), using an intermediate 1140×1140 pallet between the second bed and the third bed of the packaging set-up, FIG. 5 is a sectional view of the bottom part of a container with the presence of a vertical rib, notably inside the container, and such as it is designed in the state of the art to guarantee the stacking pitch between two containers stacked one inside the other, FIG. 6 is a sectional view illustrating the stacking pitch obtained between two containers according to FIG. 5, the bottom of the upper container bearing on the top end of the internal ribs of the lower container and as is known from the state of the art in order to guarantee the stacking pitch between two containers stacked one inside the other, FIG. 7 is a detailed view of two foldable skirt sections at a corner section, which skirt sections may each be spaced apart, manually, from an engagement position illustrated in FIG. 7 for facilitating the removal of the lid, and below which there are vertical ribs projecting toward the outside of the container, serving as stacking pitch, FIG. 8 is a detailed view illustrating the operation of the vertical ribs, the flat parts at the lower ends of the vertical ribs of the upper container bearing on the upper edge formed by the first engagement portion of the lower container, FIG. 9 is a plan view of the lid, illustrating a pre-cut opening closed by a breakable closure member, FIG. 10 is a detailed view of FIG. 9, FIG. 11 is a perspective view of the packaging, FIG. 12 is a detailed view of the assembly between the lid and the container, at a corner, FIG. 13 is a vertical sectional view, at a corner, passing through the vertical rib servings as stacking pitch, when the lid covers the opening, the foldable skirt section being in the engagement position, FIG. 14 is a vertical sectional view passing through one of the side walls, illustrating the interlocking between the first engagement portion of the container and the second engagement portion of the lid.

Thus, the invention relates to a packaging 1 comprising, on the one hand, a plastic container 2 comprising side walls 20, 21, 22, 23 meeting in corners 24, an upper opening 25 and a bottom 26 and, on the other hand, a detachable plastic lid 4 configured to cover the upper opening of the container 2.

The plastic material used may be a food-grade polypropylene or even polyethylene, by way of non-limiting examples.

Said container 2 is provided, at the upper opening 25 thereof, with a first engagement portion 34 bearing an outwardly-directed ridge 27, and extending over the periphery, said lid being provided over the periphery thereof with a second engagement portion 40 extending downwardly in a folded manner and provided with an inwardly-directed ridge 41, which is able to attach below the ridge 27 that is directed toward the outside of the container.

The upper opening 25 of the container is closed by positioning the second engagement portion 40 of the lid over the first engagement position 34 of the container, then by applying a force to the lid so as to obtain interlocking between two engagement portions by elastic deformation of these portions (namely the first engagement portion, the second engagement portion, or both), and until the inwardly-directed ridge 41 of the lid passes beneath the outwardly-directed ridge 27 of the container. Once the lid is thus "clipped in", the inner volume of the packaging is insulated in a leaktight manner against insects in particular.

The side walls 20, 21, 22, 23 of the container 2 are divergent along the height, together forming a truncated pyramid; these side walls 20, 21, 22, 23 are configured so that said container 2 can be stacked in an identical container. When not in use, and as illustrated in FIG. 1*b* for two packaging containers in accordance with the invention, it is possible to stack one of the containers inside the other.

Also notably, a constant stacking pitch with the reference Dep is provided between the two containers stacked one inside the other and such that the spacing between the side walls belonging to the two containers stacked one inside the other is between 0.2 mm and 2 mm, and in particular between 0.3 mm and 1.2 mm. This spacing between the side walls is illustrated by way of example in FIG. 2*b* (with a value of 0.49 mm), and measures the distance separating two juxtaposed side walls belonging respectively to the two containers stacked one inside the other. Such a spacing enables the operator to hold and remove the upper container from the lower container, without any suction effect, simplifying handling. This stacking pitch Dep measures the heightwise dimension separating two containers stacked one inside the other. This dimension can be seen for the invention in FIG. 8 and in FIG. 13 and in FIG. 6 for a container according to the prior art.

FIGS. 5 and 6 are views illustrating the way in which the containers of the prior art, stacked one inside the other, guarantee the presence of a stacking pitch by means of inwardly-projecting vertical ribs. These vertical ribs serving as stacking pitch have the reference N and extend from the bottom 26' over the bottom part of the corners of the container. When the upper container is stacked in a lower container, the bottom 26' of the upper container comes into abutment against the flat parts at the end of the internal ribs of the lower container, guaranteeing the presence of a stacking pitch. The stacking pitch is configured such that the spacing between two side walls is 0.8 mm, as illustrated in FIG. 6.

Notably, and according to this prior art, the ribs are provided inside the container, and therefore project in the direction of the contents. The invention arose from the inventor's observation that these ribs projecting toward the contents are incompatible with one of the aims of the invention, the object of which is not to degrade the properties of the product contained therein during dynamic storage.

For example and for packaging food or pharmaceutical powders, indirectly contained in a flexible leaktight bag internal to said container of said packaging, such vertical ribs will create friction on the flexible bag during transport-induced movements. This friction may generate weak points in the flexible bag, which may go as far as to tear the bag. Alternatively, and for the packaging of food or pharmaceutical powders directly contained in the inner volume of the container of the packaging, such vertical ribs will create friction on the powder contained therein. This friction on the powder may cause a change in these properties, and in particular an alteration to the texture thereof.

The container of the packaging in accordance with the invention is advantageously devoid of such internal ribs serving as stacking pitch. The inner surfaces of the container, including those of the bottom 26, the side walls 20, 21, 22, 23, and the corners 24, are preferably smooth, devoid of ribs or other protuberances likely to attack the contents.

The container in accordance with the invention has projecting portions 29 extending from the side walls at the upper opening 25 of the container and below said first engagement portion 34 of the container, said projecting portions 29 being notably, and according to the invention, outside the container, and not inside as in the abovementioned prior art illustrated in FIGS. 5 and 6.

These referenced projecting portions 29 are configured to guarantee a constant stacking pitch between the container 2 and said identical container 2' when said container is stacked inside said identical container, said projecting portions 29 being configured so as to cooperate in abutment with the upper edge 30 of the upper opening 25 of the identical container, inside which said container is stacked, in order to guarantee said stacking pitch.

Said projecting portions 29 are in the form of outer ribs 31, extending vertically below said first engagement portion 34 of the container. Each vertical outer rib 31 has, at the bottom end thereof, a flat part 32 intended to cooperate in abutment with the upper edge 30 of the upper opening of the identical container inside which said container is stacked. Said projecting portions 29 are arranged to project outwardly from the corners 24. When the side walls 20, 21, 22, 23 are four in number, four projecting portions 29 can be provided to project from the four corners 24 separating the side walls.

According to one embodiment, the height of the outer rib 31 in the vertical defines the stacking pitch Dep, and as illustrated in the figures by way of example. The outer rib 31 extending from the flat part 32, at the bottom end thereof, up to the upper edge 30 of the container, at the top end thereof.

According to one embodiment, which can be understood from FIG. 14, the first engagement portion 34 of the container bearing said outwardly-directed ridge 27 of the of the container extends downwardly in a folded manner, covering the side walls 20, 21, 22, 23 and the corners 24 over an upper part of the height of the container, with the presence of a peripheral cavity Int in the interspace. This cavity, which extends at the periphery of the container, is delimited between the outer surface of the side walls 20, 21, 22, 23 and the corners 24 on the one hand, and the folded section of the engagement portion 34 on the other.

The presence of vertical reinforcing ribs 35 is also noted, which are distributed in said cavity over the periphery of the container, each reinforcing rib 35 connecting one of the side walls 20, 21, 22, 23 or wall of the corners 24, on the one hand, to said folded section of the first engagement portion 34, on the other hand, as can be seen in FIG. 12. Each rib extends projecting substantially perpendicularly to the wall forming the corner or to the wall forming the side wall.

According to one embodiment, it is noted that the outer ribs 31 guaranteeing the constant stacking pitch each extend from the bottom end thereof that forms the flat part 32, located below the cavity Int and from said first engagement portion 34 of the container and up to the inside of said cavity Int where said vertical outer rib 31 is elongated, forming one of the reinforcing ribs 37. In such a case, the outer rib 31 fulfills a dual function, namely a function of producing the stacking pitch and a function of reinforcing rib 37, by connecting in particular the corner 24 and the folded section of the first engagement portion 34.

According to the invention and as can be seen in FIG. 7, the second engagement portion 40 of the lid has a skirt 42 that extends over the lower part of the second engagement portion 40 and wherein said outwardly-directed ridge 27 of the container, on the one hand, and the inwardly-directed ridge 41 of the lid, on the other hand, having curved corner sections 28, 43 in the corners 24 where said side walls 20, 21, 22, 23 meet, where at least one of the curved corner sections of the inwardly-directed ridge 41 is provided with a foldable skirt section 44, articulated via a folding region 46 to the upper part of the second engagement portion 40 of the lid.

This foldable skirt 44 is able to fold from an engagement position to an outwardly-directed released position such that a central part of said at least one curved corner section of the inwardly-directed ridge 41 is spaced apart by levering from the outwardly-directed ridge 27 of the upper opening 29 and that the engagement between the ridges 27, 41 is thus weakened over said central part. The foldable skirt 44 can be moved from the engaged position to the released position manually, facilitating the removal of the lid which can be carried out without tools.

According to one embodiment, said foldable skirt section 44 is separated from the remaining skirt section 42 by means of two grooves 45 formed in the external surface of the skirt 42 and extending downwardly from a folding region 46 to the lower edge of the skirt 42, said grooves 45 reducing the wall thickness of the skirt 42 such that the skirt can be broken along the grooves 45 in order to fold the foldable skirt section 44 into the outwardly-directed position thereof. The lid 4 may have four foldable skirt sections at the four corners of the lid, when the container having four side walls. For the production of such foldable sections 44, a person skilled in the art may for example refer to document EP 1.380.516 A1.

According to the invention, at least one of the outer ribs 31 extends, at the corners 24, from the bottom end thereof which forms the flat part 32 and at least up to the height of said foldable skirt section 44 when the inwardly-directed ridge 41 is in the engagement position with the outwardly-directed ridge 27 of the container 2. For example, and as can be seen in FIG. 13 by way of example, said outer rib 31, in line vertically with the foldable skirt section 44, is, along a horizontal direction passing through the plane of the outer rib 31, of increasing dimension between the lower end thereof that forms the flat part 32 and the lower end 48 of the foldable skirt section 44.

For example, and in FIG. 13 it is noted that said outer rib 31 forms a ramp 33 moving outwardly further away as the lower end 48 of the foldable skirt section 44 is approached from the flat part 32 of the lower end of the outer rib 31, thus in the engagement position. The position of the vertical outer rib 31, close to and below the foldable skirt section 44, or even the ramp 33 thus created, advantageously constitute an obstacle that limits the risks of accidental opening of the folded skirt sections 44 by unfortunate pushing by an object that might accidentally come under the skirt section 44 during uncontrolled handling. In particular, when the lid has four foldable skirt sections 44 at these four corners, four vertical ribs 31 positioned at the four corners of the container extend respectively in line with the four skirt sections 44. Each of the vertical ribs 31 thus extends, at the corners 24, from the bottom end thereof which forms the flat part 32 and at least up to the height of said foldable skirt section 44 when the inwardly-directed ridge 41 is in the engagement position with the outwardly-directed ridge 27 of the container 2. Each rib then constitutes an obstacle limiting the risks of accidental opening of the foldable skirt sections 44 by preventing undesired pushing under the foldable skirt.

According to one embodiment, and as can be seen by way of non-limiting example according to FIG. 13:

- the first engagement portion 34 of the container bearing the outwardly-directed ridge 27 extends and is elongated below said ridge 27, referred to as first ridge, and ends below said first ridge in a second ridge 35, also outwardly-directed,
- the foldable skirt section 44 bearing the inwardly-directed ridge 41 able to attach to the first ridge 27 bears, in the engagement position of the foldable skirt section 44, a second inwardly-directed ridge 47 able to attach to the second outwardly-directed ridge 35 of the first engagement portion 34.

The optional presence of a double ridge 41 and 47 makes it possible to increase the strength of the second engagement portion 40 of the lid 4 on the first engagement portion 34 of the container.

Increasing the strength of the lid on the container may be advantageous for any number of reasons, and in particular in order to enable the handling and lifting of the packaging by means of a suction lifting device that engages with the lid of the packaging at the center thereof, since the connection between the lid and the container has to be sufficiently strong to sustain the weight of the packaging and the contents thereof while said packaging is suspended by its lid. According to one embodiment, the container has a usable capacity of between 40 liters and 60 liters. In the case of packaging, a capacity of 40 liters to 60 liters, since the density of the powders is very often between 0.4 and 0.6, it will be understood that the connection between the lid and the container must be capable of lifting a weight of the order of 20 kg to 30 kg to enable suction handling.

According to one embodiment, two handles 36 extend along the height of the container, each handle 36 being positioned below the engagement portion 34 of the container and above, or at the level of, the lower ends serving as stops of the projecting portions 29 guaranteeing the constant stacking pitch, said handles 36 extending in a laterally projecting manner from two opposite side walls 21, 23 of the container.

According to one embodiment, which can be understood from FIGS. 1*b* and 2*b*, the side walls 20, 21, 22, 23 are four in number, namely a container with a rectangular section and in particular:

- the dimension d1 being the overall dimension of the packaging along a first horizontal direction passing through the two handles and consisting of the distance separating the two handles 36,
- the dimension d2 being the overall dimension d2 along a horizontal direction perpendicular to the first horizontal direction and wherein $0.95\ d1<d2<1.05\ d1$.

For example, and in FIG. 2*b*, the dimension d1 is 386 mm and in FIG. d2, the dimension is 387 mm, namely a substantially identical dimension. Providing an overall dimension that is identical or virtually identical along the two directions makes it possible to place nine packagings side-by-side on a 1140 mm×1140 mm pallet, arranged in three columns and three rows according to a 3×3 configuration, optimizing the capacity of the pallet.

Generally, the dimension d1 and the dimension d2 may be between 380 mm and 390 mm. The height of the container from the bottom to the upper edge of the first engagement portion 34 may be between 450 mm and 550 mm and for example 517.7 mm as illustrated in FIG. 1*b*.

According to one embodiment, the dimension in terms of thickness of the side walls 20, 21, 22, 23 is between 2 mm and 2.2 mm, such as 2.1 mm, the container being able to withstand a compressive force of between 40 kilograms and 105 kilograms, and preferably of the order of 75 kilograms, applied to the lid 4 in the engagement position on the upper opening of the container.

This makes it possible to pile three or even four packagings (with products contained therein) one on top of the other. For example, FIG. 4 is a perspective view of a packaging set-up comprising a 1140 mm×1140 mm pallet on which four packaging beds rest, piled one on top of the other, each bed being formed of 9 packagings arranged side-by-side according to a square configuration (3×3), using an intermediate 1140 mm×1140 mm pallet between the second bed and the third bed.

According to an advantageous embodiment, the wall of the lid 4 has a pre-cut opening closed by a breakable closure member 5. A breakable line 50, formed by a reduction in the section of the lid 4 wall defines the contour of the closure member 5 and of said pre-cut opening, said breakable line 50 being configured such that manual pressure on the closure member 5 ensures the breakage of the breakable line 50 and thus the release of the pre-cut opening.

It is thus possible to get rid of the closure member 5 by simple manual pressure thereon. The opening thus released enables the introduction of an analysis probe, such as a Raman spectrometer analysis probe.

According to an advantageous embodiment, it is noted that said breakable line 50 extends at the periphery of the closure member 5 with the exception of a region intended to form a retaining tab 51 for the closure member 5 once said breakable line 50 has been severed. This breakable line 50 is thus configured such that manual pressure on the closure member ensures the breakage of the breakable line 50 and thus the release of the pre-cut opening, then the holding of the closure member 5 below the wall of the lid 4 via said flexible retaining tab 51.

It is noted that the position of this pre-cut opening (with the breakable closure member thereof) is not determined randomly, the latter being positioned at a distance from the corner regions of the lid where the base of a container of a packaging piled on the lid of the packaging is likely to bear: this thus avoids the action of the weight of a packaging on the lid from severing the breakable line 50 and accidentally opening the opening. Likewise, it is noted that the pre-cut opening is at a distance from the center of the lid: this thus avoids the press used to place the lid on the container from severing the breakable line, or even avoids the suction cup of a lifting device used to lift the packaging and its contents by a suction effect on the center of the cover from weakening or even severing said breakable line.

It is further noted that the pastille forming the closure element may be embossed with a visual informing of the region of the closure member on which it is necessary to push in order to release the pre-cut opening.

Also, with the lid 4 being substantially of rectangular shape, comprising four corners 49, and as illustrated in FIG. 9, it is noted that the pre-cut opening and the closure member 5 are located on the lid at a distance from the corners 49 along an axis of symmetry A of the lid, and in an off-center position relative to the center C of the lid.

The container 2 and said lid 4 can typically be obtained by injection molding. In such a case, the die and the punch will make it possible to obtain the various characteristics of the packaging during the molding, such as the vertical outer ribs serving as stacking pitch, the breakable foldable skirt sections, the pre-cut opening with the breakable closure member thereof, enabling the production of a lower-cost packaging. It is further noted that the retaining tab 51 is positioned on the side of the closure member 5 that is facing in the opposite direction to the center of the lid. This enables the insertion of the probe through the opening and, while the closure member is held by the retaining tab 51, in a position in which the probe may be inclined toward the center of the container without the retaining tab and the held closure member opposing such an inclination.

The packaging in accordance with the invention is particularly used for packaging food or pharmaceutical powders, directly contained in the inner volume of the container of the packaging, or indirectly contained in a flexible leaktight bag internal to said container of said packaging.

The method for packaging the powdered product may provide the following steps:

- a step a) of inserting the powdered product into a flexible bag via an upper opening in the bag,
- a step b) of closing the upper opening of the flexible bag in a leaktight manner, for example by heat sealing or else by ultrasonic welding of the flexible bag,
- a step c) of inserting the filled (or even closed in a leaktight manner) flexible bag into the inner volume of the container, via the upper opening 25 thereof,
- a step d) of positioning the lid of the packaging on the upper opening of the container,
- a step e) of placing the lid, by pressure applied on the lid, in order for the first engagement portion 34 of the container 2 to interlock with the second engagement portion of the lid, and until said inwardly-directed ridge 41 of the lid passes beneath, and attaches to, said ridge 27 of the container.

Alternatively, the flexible bag can be inserted empty into the container of the packaging, the step a) of inserting the powdered product and the step b) of closing then being carried out while the flexible bag is already positioned in the container and before the lid is placed on.

The step e) of placing the lid may be carried out by means of an actuating cylinder, ensuring, at the start of travel, a light pressure on the lid in order to enable pre-interlocking of the lid on the container (of the first engagement portion 34 of the container with the second engagement portion 40 of the lid) and, at the end of travel, a much higher pressure ensuring the attachment of the ridges 27 and 41 to one another, or even of ridges 35 and 47.

NOMENCLATURE

Invention

1. Assembly,
2. Container,
20, 21, 22, 23. Side walls,
24. Corners,
25. Upper opening,
26. Bottom,
27 Ridge (first),
28. Curved section (ridge 27),
29. Projecting portion (serving as stacking pitch),
30. Upper edge,
31. Outer ribs (projecting portion serving as stacking pitch),
32. Flat part (lower end vertical rib),
33. Ramp (outer ribs),
34. First engagement portion (upper opening 25 container),
35. Second outwardly-directed ridge,
36. Handles,
4. Lid,
40. Second engagement portion,
41. (First) inwardly-directed ridge,
42. Skirt,
43. Curved section (ridge 41),
44. Foldable skirt section,
45. Breakable grooves,
46. Folding region (foldable skirt section 44),
47. Second ridge (inwardly-directed),
48. Lower end (foldable skirt section),
49. Corners (lid),
5. Breakable closure member,
50. Breakable line,
51. Retaining tab,
A. Lid axis of symmetry,
C. Lid center,
Dep. Stacking pitch, Prior art (FIGS. 5 and 6)
2' Container,
26' Bottom,
N. Internal ribs serving as stacking pitch,
Dep. Stacking pitch,

The invention claimed is:

1. A packaging comprising a plastic container, comprising side walls meeting in corners, an upper opening and a bottom, as well as a detachable plastic lid, configured to cover the upper opening of the container, and wherein said container is provided, at the upper opening thereof, with a first engagement portion bearing an outwardly-directed ridge that extends over the periphery, said lid being provided, over the periphery thereof, with a second engagement portion extending downwardly in a folded manner and provided with an inwardly-directed ridge, which is able to attach below the ridge that is directed toward the outside of the container, and wherein said side walls of the container are divergent, together forming a truncated pyramid, configured so that said container can be stacked in an identical container, said container having projecting portions extending from side walls at the upper opening of the container and below said first engagement portion of the container, said projecting portions being outside the container and being in the form of outer ribs, extending vertically below said first engagement portion of the container, each outer rib, having, at the bottom end thereof, a flat part intended to cooperate in abutment with the upper edge of the upper opening of the identical container inside which said container is stacked, said projecting portions being configured to guarantee a constant stacking pitch between the container and said identical container, when said container is stacked in said identical container, said projecting portions being configured so as to cooperate in abutment with the upper edge of the upper opening of the identical container inside which said container is stacked so as to guarantee said stacking pitch, and wherein the second engagement portion of the lid has a skirt that extends over the lower part of the second engagement portion and wherein said outwardly-directed ridge of the container and the inwardly-directed ridge of the lid having curved corner sections in the corners where said side walls meet, where at least one of the curved corner sections of the inwardly-directed ridge is provided with a foldable skirt section, articulated via a folding region to the upper part of the engagement portion, the folding region being a hinge made by a wall constriction, said engagement portion able to fold around said hinge from an engagement position to an outwardly-directed released position such that a central part of said at least one curved corner section of the inwardly-directed ridge is spaced apart by levering from the outwardly-directed ridge of the upper opening and that the engagement between the ridges is thus weakened over said central part and wherein said projecting portions are arranged to project outwardly from the corners, at least one of the outer ribs extending, at the corners, from the bottom end thereof which forms the flat part and at least up to the height of said foldable skirt section when the inwardly-directed ridge is in the engagement position with the outwardly-directed ridge of the container, wherein the first engagement portion of the container bearing said outwardly-directed ridge of the container extends downwardly in a folded manner, covering the side walls and the corners over the height of the container, with the presence of a peripheral cavity in the interspace between the outer surface of the side walls and the corners, and the folded section of the engagement portion, and wherein vertical reinforcing ribs are distributed in said cavity over the periphery of the container, each reinforcing rib connecting one of the side walls or wall of the corners to said folded section of the first engagement portion, wherein the outer ribs guaranteeing the constant stacking pitch each extend from the bottom end thereof that forms the flat part, located below the cavity and from said first engagement portion of the container and up to the inside of said cavity where said vertical outer rib is elongated, forming one of the reinforcing ribs, wherein said foldable skirt section is separated from the remaining skirt section by means of two grooves formed in the external surface of the skirt and extending downwardly from a folding region to the lower edge of the skirt, said grooves reducing the wall thickness of the skirt such that the skirt can be broken along the grooves in order to fold the foldable skirt section into the outwardly-directed position thereof, wherein the first engagement portion of the container bearing the outwardly-directed ridge extends and is elongated below said ridge, referred to as first ridge, and ends below said first ridge in a second ridge, also outwardly-directed, and wherein the foldable skirt section bearing the inwardly-directed ridge able to attach to the first ridge bears, in the engagement position of the foldable skirt section, a second inwardly-directed ridge able to attach below the second outwardly-directed ridge of the first engagement portion and wherein the foldable skirt section extends, in the corner, below the second outwardly directed ridge down to a lower end of the foldable skirt, in the engagement position of the fordable skirt section and wherein said outer rib in line with the foldable skirt section is, along a horizontal direction passing through the plane of the outer rib, of increasing dimension between the lower end thereof that forms the flat part and the lower end of the foldable skirt section, said outer rib thus forming a ramp moving outwardly further away as the lower end of the foldable skirt section is approached from the flat part at the lower end of the vertical rib, configured so that the vertical outer rib, close to and below the foldable skirt section, and the ramp constitute an obstacle that limits the risks of accidental opening of the folded skirt section by unfortunate pushing by an object that might accidentally come under the lower end of skirt section.

2. The packaging according to claim 1, wherein the stacking pitch guaranteed between the container and said identical container is such that the side walls of the container and the side walls of the identical container are spaced apart by a distance of between 0.4 mm and 1.2 mm.

3. The packaging according to claim 1, wherein the height of the outer rib in the vertical defines the stacking pitch, said outer rib extending from the flat part serving as a stop, at the bottom end thereof, up to the upper edge of the container, at the top end thereof.

4. The packaging according to claim 1, wherein the inner surfaces of the container, including those of the bottom, the side walls and the corners, are devoid of ribs.

5. The packaging according to claim 1, wherein two handles extend, along the height of the container, each handle being positioned below the engagement portion of the container and above or at the level of the lower ends serving as stops of the projecting portions guaranteeing the constant stacking pitch, said handles extending in a laterally projecting manner from two of opposite side walls of the container.

6. The packaging according to claim 1, wherein the side walls are four in number, the section of the container being rectangular.

7. The packaging according to claim 5, wherein:

the dimension d1 being an overall dimension of an assembly along a first horizontal direction passing through the two handles and being the distance separating the two handles, the dimension d2 being an overall dimension along a horizontal direction perpendicular to the first horizontal direction and wherein $0.95\ d1<d2<1.05\ d1$.

8. The packaging according to claim 1, wherein the container has a usable capacity of between 40 liters and 60 liters.

9. The packaging according to claim 1, wherein the dimension in terms of thickness of the side walls is between 2 mm and 2.2 mm, the container is able to withstand a compressive force of between 40 kilograms and 105 kilograms, applied to the lid in the engagement position on the upper opening of the container.

10. The packaging according to claim 1, wherein the wall of the lid has a pre-cut opening closed by a breakable closure member, a breakable line, formed by a reduction in the section of the lid wall defining the contour of the closure member and of said pre-cut opening, said breakable line being configured such that manual pressure on the breakable closure member ensures the breakage of the breakable line and thus the release of the pre-cut opening.

11. The packaging according to claim 10, wherein said breakable line extends at the periphery of the closure member with the exception of a region intended to form a retaining tab for the closure member once it has been severed, said breakable line being configured such that manual pressure on the breakable closure member ensures the breakage of the breakable line and thus the release of the pre-cut opening, then the holding of the closure member below the wall of the lid via said flexible retaining tab.

12. The packaging according to claim 11, wherein the lid substantially is of rectangular shape, comprising four corners and wherein the pre-cut opening and the breakable closure member are located on the lid at a distance from the corners along an axis of symmetry of the lid, and in an off-center position relative to the center of the lid.

13. A use of the packaging according to claim 1 for packaging food or pharmaceutical powders, directly contained in the inner volume of the container of the packaging, or indirectly contained in a flexible leaktight bag internal to said container of said packaging.

14. A method for manufacturing the packaging according to claim 1, wherein the container and said lid are obtained by injection molding.

* * * * *